United States Patent [19]

Christian

[11] Patent Number: 4,517,902

[45] Date of Patent: May 21, 1985

[54] CONTROL CIRCUIT FOR A SOLID FUEL FURNACE

[76] Inventor: J. Vernon Christian, 2160 Longreen Rd., Kingsport, Tenn. 37660

[21] Appl. No.: 499,468

[22] Filed: May 31, 1983

[51] Int. Cl.[3] ..... F23N 5/02

[52] U.S. Cl. ..... 110/190; 236/11; 236/15 BA

[58] Field of Search ..... 236/15 BA, 11, 9, 9 A; 110/188, 190

[56] References Cited

U.S. PATENT DOCUMENTS

| | | | |
|---|---|---|---|
| 2,277,621 | 3/1942 | Weber | 236/9 |
| 2,405,982 | 8/1946 | Schweickart et al. | 110/277 |
| 2,533,330 | 12/1950 | Schweickart et al. | 110/275 X |

*Primary Examiner*—William E. Wayner

*Attorney, Agent, or Firm*—Joseph R. Slotnik

[57] ABSTRACT

A control circuit for a solid fuel furnace which includes a combustion chamber, means for delivering solid fuel to the combustion chamber, and means for delivering combustion air to the combustion chamber, wherein the control circuit includes thermo-sensitive means responsive to a demand temperature and to a temperature related to furnace performance to control the fuel delivery means and the combustion air delivery means for maximum furnace efficiency, minimum fuel consumption and minimum soot and smoke formation. In addition, the control circuit includes "hold fire" circuit which is operable in response to combustion-related temperatures and during periods when the demand temperature is met to control the fuel delivery means and the combustion air delivery means to maintain combustion in the combustion chamber.

9 Claims, 2 Drawing Figures

Fig. 1
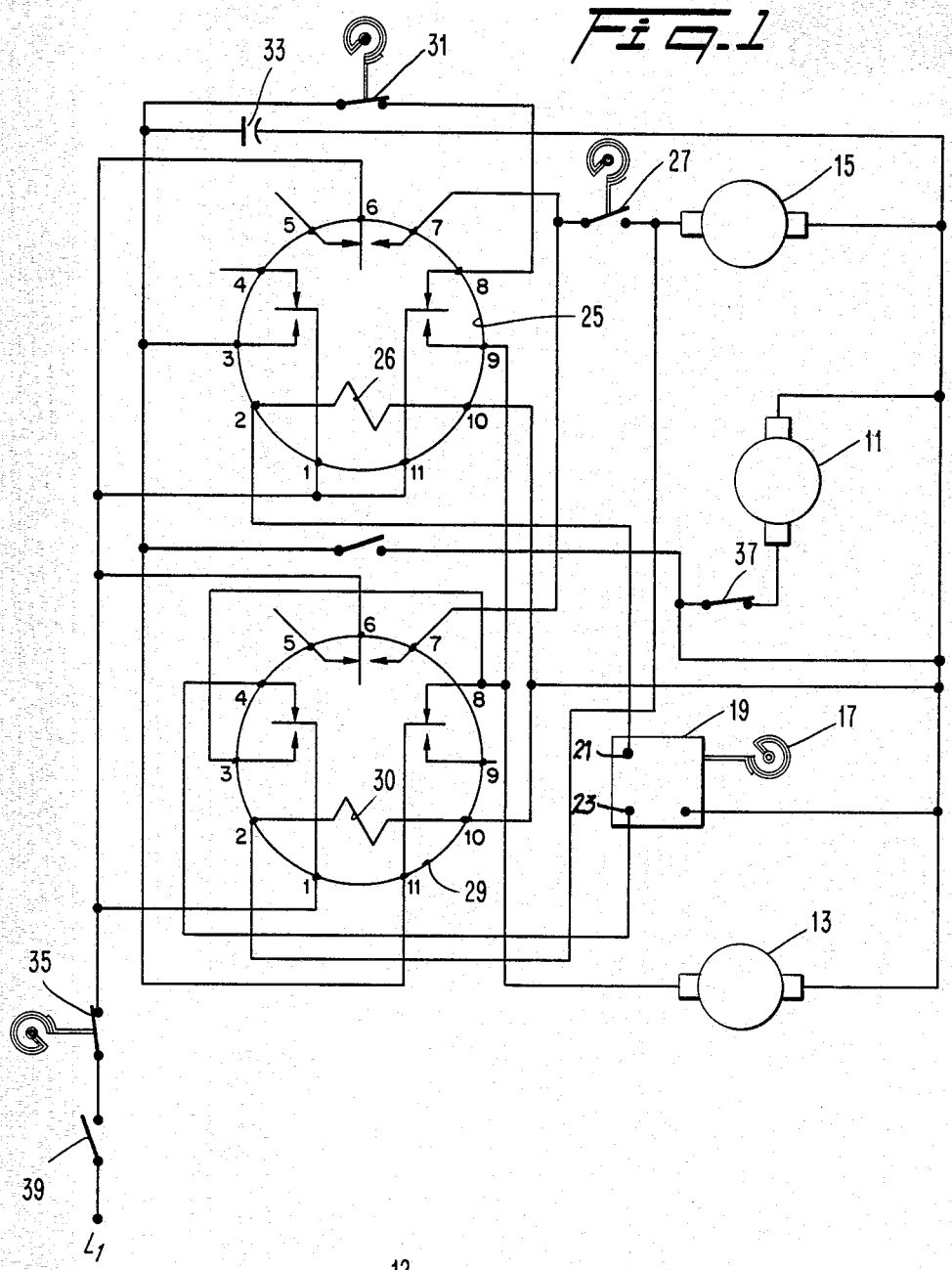
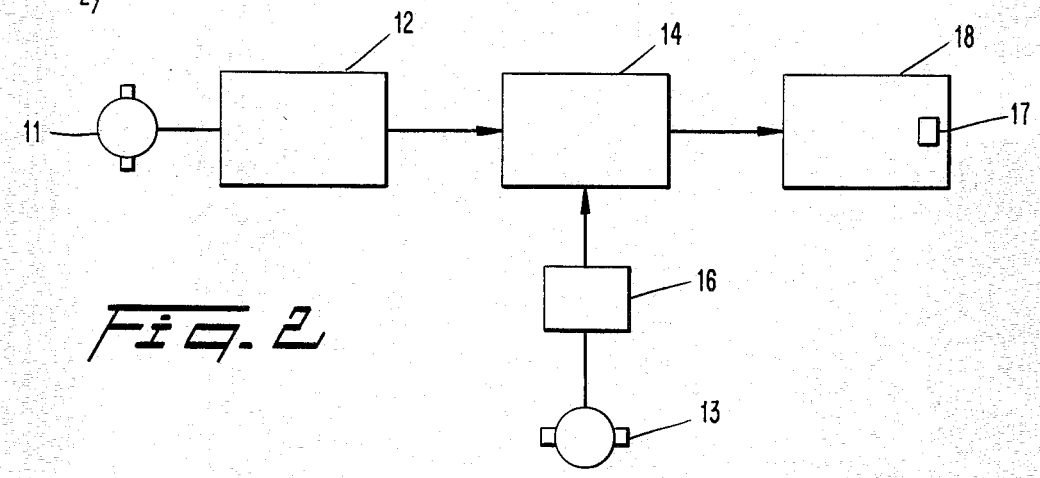
Fig. 2

CONTROL CIRCUIT FOR A SOLID FUEL FURNACE

BACKGROUND OF THE INVENTION

The present invention relates to a control circuit for a solid fuel furnace which includes a combustion chamber, a device for delivering solid fuel and a device for delivering combustion air to the combustion chamber. The heat from combustion can be used, for example, to heat warm air or water which, in turn, are conveyed to a comfort zone. The furnace includes thermo-sensitive means which establishes the set point temperature for the furnace and controls the delivery of fuel and combustion air to the combustion chamber during periods when the set point temperature is not met to maximize combustion efficiency and minimize fuel consumption and smoke and soot formation. The invention also includes a thermo-sensitive means responsive to flue gas or furnace temperature to control delivery of fuel and combustion air to the combustion chamber during periods when the set point temperature is met to maintain the fire bed ready to supply heat upon demand.

In the typical solid fuel furnace, the fuel delivery means and the means for delivering combustion air to the combustion chamber operate together. When the set point temperature is met, for example, when the temperature of the comfort zone (room) heated by the furnace reaches the set temperature of a thermostat in that zone (room), both the fuel delivery and combustion air delivery means turn off. This often leaves a large quantity of raw fuel in the fuel bed so that large quantities of volatiles in the raw fuel are released into the furnace atmosphere. Since the combustion air delivery means has been turned off, there is a deficiency of combustion air in the furnace atmosphere causing heavy smoking and sooting which contaminates the air, furnace surfaces and parts, and the raw fuel in the fuel bed. This results in air pollution, reduction in furnace efficiency, and excessive fuel consumption.

In furnaces of this type, it is desirable also to provide a "holdfire" system to maintain the fire bed ready to supply heat upon demand, e.g., when the temperature in the comfort zone falls below the set point. The "holdfire" system should function only when necessary to avoid excessive fuel consumption.

SUMMARY OF THE INVENTION

The present invention overcomes the problems and satisfies the needs described above by providing thermo-sensitive circuits which are responsive to demand temperature and to a temperature related to furnace performance to control operation of the fuel and combustion air delivery means for maximum performance and combustion efficiency and resulting comfort, and minimum fuel consumption. In a preferred form, one circuit energizes the fuel delivery and combustion air delivery means in response to thermostat demand at a comfort zone, and another circuit energizes a heated air delivery means (forced air fan) and maintains the combustion air delivery means energized while deenergizing the fuel delivery means when the temperature in the furnace reaches a pre-selected level sufficient to heat the forced air. When the furnace temperature falls below the preselected level, the latter circuit is interrupted and the first circuit energizes both the fuel delivery and combustion air delivery means if the thermostat demand has not been met.

In accordance with a further aspect of the invention, a third circuit is operable, during periods when the demand temperature is met, to selectively energize the fuel delivery and combustion air delivery means. This circuit is termed a "holdfire" circuit and maintains combustion in the fire bed with minimum fuel consumption and provides for instantaneous delivery of heat upon thermostat demand.

Additional objects of the invention are to provide a control circuit for a solid fuel furnace which can be used with solid fuel furnaces employing a variety of solid fuels, which can be retrofit to existing solid fuel furnaces, and which is relatively inexpensive and yet reliable in performance.

Other objects and advantages of the invention will be set forth in part in the description which follows, and in part will be obvious from the description, or may be learned by practice of the invention. The objects and advantages of the invention may be realized and attained by means of the instrumentalities and combinations which are particularly pointed out in the appended claims.

To achieve the objects and in accordance with the purpose of the invention, as embodied and broadly described herein, a control circuit is provided for a solid fuel furnace which includes a combustion chamber, means for delivery solid fuel to the combustion chamber, and means for delivering combustion air to the combustion chamber; the control circuit comprising first circuit means including first thermo-sensitive means operable in response to a a temperature sensed by the first thermo-sensitive means below a first preselected temperature to energize the fuel delivery means and the combustion air delivery means, second circuit means including second thermo-sensitive means and operable in response to a temperature related to furnace performance above a second preselected temperature and to interrupt the first circuit means while maintaining the combustion air delivery means energized, the second thermo-sensitive means being operable to interrupt the second circuit means in response to furnace performance related temperatures below the second preselected temperature. If the temperature sensed by the first thermo-sensitive means remains below the first preselected temperature, the first circuit means reenergizes the fuel delivery and combustion air delivery means.

The furnace performance related temperature can be the temperature at or near the combustion zone or in a heat exchanger used to heat forced air to be delivered to a comfort zone, or it can be the temperature of water heated by the heat of combustion. The first thermo-sensitive means can be a thermostat which senses the temperature in a comfort zone or can sense the heated water temperature.

In addition, the control circuit of this invention includes a third circuit means including a third thermo-sensitive means responsive to a temperature related to fuel combustion and operable at temperatures below a third preselected level and during periods when the temperatures sensed by the first thermo-sensitive means is at or above the first preselected temperature, to energize the fuel delivery means and the combustion air delivery means, the third temperature responsive means being operable to interrupt the third circuit means in response to a fuel combustion related temperature above the third preselected level.

The combustion related temperature can be measured at or near the combustion chamber, but preferably is measured at the flue gas exit of the furnace.

The accompanying drawings, which are incorporated in and constitute a part of this specification, illustrate embodiments of the invention and, together with the description, serve to explain the principles of the invention.

BRIEF DESCRIPTION OF THE DRAWING

FIG. 1 is a schematic diagram of a control circuit constructed in accordance with a preferred embodiment of the present invention and FIG. 2 is a schematic diagram showing the inter connection between several component parts in the system embodying the present invention.

DESCRIPTION OF THE PREFERRED EMBODIMENT

Reference will now be made in detail to the present perferred embodiment of the invention, an example of which is illustrated in the accompanying drawing.

The preferred embodiment of control circuit of the present invention is shown in FIG. 1. This control circuit is useful with a solid fuel furnace which includes a combustion chamber, means for delivering solid fuel to the combustion chamber, and means for delivering combustion air to the combustion air to the combustion chamber. The furnace produces heat by combustion which is used to heat a fluid, such as air or water, which, in turn, can heat a comfort zone. Heated air can heat the comfort zone (room) by convection, or means such as a forced air fan can be provided to deliver the heated air to the comfort zone.

One type of furnace in which the present invention finds particular use includes an underfeed stoker (not shown) which is adapted to deliver solid fuel, e.g., coal, wood, sawdust, etc., upwardly into a stationary tuyere (not shown) enclosed in a furnace housing (not shown) forming a combustion chamber 14. Fuel is delivered to the stoker by means of a stoker motor 11 which drives an auger feed device (12). Combustion air is delivered to the combustion chamber 14 by a motor 13 which drives a fan (16) to supply air to the combustion chamber. The heat from combustion in the combustion chamber can pass to a heat exchanger (not shown) and used to heat recirculating air forced through the heat exchanger by a warm air fan driven by a motor 15. The heated air from the heat exchanger is then delivered to a comfort zone 18, e.g., rooms of a house. For a detailed illustration and description of a furnace of this type, reference may be made to applicant's copending application, Ser. No. 485,827, Filed Apr. 18, 1983, and which is incorporated herein by reference in it's entirety.

It will be appreciated, however, that the control circuit of this invention can be used with a variety of other types of solid fuel furnaces which include fuel delivery and combustion air delivery means and which are used to heat other fluids such as water, and that the control circuit of this invention can be retrofit into all such furnaces.

In accordance with the invention, the control circuit comprises first circuit means including first thermo-sensitive means operable in response to a temperature sensed by the first thermo-sensitive means below a first preselected temperature to energize the fuel delivery means and the combustion air delivery means.

As embodied herein, the first circuit means includes a thermostat 17 which is constructed in the usual manner as will be understood by those skilled in the art and is adapted to be set at a desired temperature. The thermostat 17 may include a thermo-sensitive resistor and a variable resistor (not shown) which is set in accordance with the desired temperature. The thermostat 17 is connected to a relay 19 and, when the temperature sensed by the thermo-sensitive resistor is below that set by the variable resister, the thermostat 17 delivers a 24 volt signal to the relay 19 and activates a set of 110 volt contacts 12,23 therein.

As further embodied herein the first circuit means includes a three pole, double throw mechanical relay 25 which is connected to the relay 19. The relay 25 includes a 110 volt coil 26 across contacts 2-10, and is normally as shown in FIG. 1 with contacts 1-4, 5-6, 8-11 "made". When the relay 19 receives a signal from the thermostat 17, it supplies power to the relay 25 and "makes" contacts 1-3, 6-7, and 9-11. Contacts 1-3 energize the stoker motor 11 and also energize the combustion air fan motor 13 through another similar relay 29 described below. Contacts 6-7 supply power to the warm air fan motor 15 and contacts 9-11 supply power to the combustion air fan motor 13. Thus, when the thermostat 17 calls for heat, power is supplied to the stoker motor 11 and to the combustion air fan motor 13 causing both solid fuel and combustion air to be delivered to the furnace.

In accordance with the invention, the control circuit comprises second circuit means including second thermo-sensitive means and operable in response to a temperature related to furnace performance above a second preselected temperature to interrupt the first circuit means while maintaining the combustion air delivery means energized, the second thermo-sensitive means being operable to interrupt the second circuit means in response to furnace performance related temperatures below the second preselected temperature.

As embodied herein, a warm air fan control switch 27 is provided between relay 25 and motor 15. Switch 27 is a normally open, thermo-sensitive switch which can include, for example, a pair of bimetallic contacts. The switch 27 is located in the furnace, preferably at or near the combustion chamber, and is adapted to close at a predetermined temperature signaling when combustion of the solid fuel in the combustion chamber has reached a point where warm air can be supplied. When the switch 27 closes, power is supplied to the warm air fan motor 15. In the case of the furnace utilizing a heat exchanger, the warm air fan forces recirculating air through the heat exchanger where it is heated and then delivered to the comfort zone.

When the switch 27 closes, it energizes another three pole, double throw, mechanical relay 29 through a contact 2 thereof. Like relay 25, relay 29 has a 110 volt coil 30 and normally "made" contacts 1-4, 5-6, 8-11. When the relay 29 is energied, contacts 1-3, 6-7, and 9-11 are "made".

Contact 23 of relay 19 is connected to line voltage through contact 4 of relay 29 so that when relay 29 is energized, power is interrupted to relay 19 and relay 25 is deenergized. Stoker motor 11 is deenergized stopping delivery of fuel to the combustion chamber. However, closed contacts 1-3 of relay 29 cause the combustion air fan motor 13 to remain energized so that combustion air continues to be delivered to the combustion chamber. Also, contacts 6-7 of relay 29 cause the warm air fan motor 15 to remain energized.

It will be appreciated that continued supply of combustion air to the combustion chamber after interrupting the operation of the stoker motor 11 allows the fuel in the combustion chamber to be completely consummed. At the same time, the heat generated by this continuing combustion is available to heat the comfort zone.

As the solid fuel in the furnace approaches total consumption by combustion, the temperature in the combustion chamber drops. When the temperature sensed by switch 27 falls below the second predetermined level, the switch 27 reopens. This causes the relay 29 to deenergize and the warm air fan motor 15 and the combustion air fan motor 13 also to deenergize. If the thermostat demand had not been met, relay 25 is again energized and the cycle begins again.

The control circuit of this invention causes the cycle to repeat as many times as necessary until the thermostat demand is met. The repeating cycles and the continued delivery of combustion air to combustion chamber after fuel feed stops in each cycle insures virtually complete combustion of all fuel in the combustion chamber when the thermostat demand is met. This greatly reduces soot and smoke formation and resulting air pollution and virtually insures that there is no wasted fuel so that the efficiency of the furnace is maximized.

In accordance with the invention, the control circuit of this invention comprises a third circuit means including a thid thermo-sensitive means responsive to a temperature related to fuel combustion and operable at temperatures below a third preselected level and during periods when the temperature sensed by the first thermo-sensitive means is at or above the first preselected temperature to energize the fuel delivery means and the combustion air delivery means. The third thermo-sensitive means is operable to interrupt the third circuit means in response to a fuel combustion related temperature above the third preselected level.

As embodied herein, a normally closed, thermo-sensitive switch 31 is provided to sense a temperature related to combustion in the furnace. The switch 31 can be located at or near the combustion chamber but preferably is positioned at the flue gas exit of the furnace. The switch 31 can be a conventional snap-acting or bimetallic switch which is normally closed and opens at a predetermined temperature at the flue gas exit. The temperature setting for the switch 31 can vary depending upon the type of fuel used in the furnace. For example, the set point of the switch 31 can be about 150° F. when burning soft coal, while a temperature setting of about 250° F. is required when burning sawdust.

The switch 31 is powered through contacts 8–11 of relay 25. When the combustion related (flue gas) temperature is below the third preselected level and relay 25 is deenergized, the switch 31 provides a direct source of power to the stoker motor 11 and the combustion air fan motor 13. Alternatively, the switch 31 could be arranged to activate only the combustion air fan motor 13, and, if the set temperature of switch 31 is not met, then both the motor 13 and stoker motor 11 are energized. At this time, which occurs during the periods when thermostat demand is met, fuel is delivered to the furnace as is combustion air and fuel combustion is maintained at a level required to satisfy the set temperature of switch 31. When the temperature sensed by the thermostat 17 falls below its set point, the relay 19 supplies power to the relay 25 and there is virtually an instantaneous supply of warm air to be available for delivery to the comfort zone. This circuit, termed a "holdfire" circuit, further enhances the efficiency of the furnace by maintaining sufficient fuel and air and resulting heat in the combustion chamber for an instantaneous supply of heat demand.

It will be understood that when the temperature in the flue gas exit goes above the third preselected level, the switch 31 opens and both the stoker motor 11 and the combustion air fan motor stop.

By providing the "holdfire" switch 31 in the flue gas exit of furnace, and not in the combustion chamber, a more accurate and reliable operation of the "holdfire" circuit is achieved. Thus, the switch 31 is not subject to hot spots which might occur as a result of burning fuel particles in the combustion chamber.

The switch 31 is preferably a snap acting switch. However, a bimetallic thermoswitch may be used in which case a capacitor 33 may be required to prevent false starts of the "holdfire" circuit.

For safety, a thermo-sensitive limit switch 35 may be provided in the circuit and constructed to open if the temperature in the furnace becomes too high. Switch 35 is a normally closed switch but opens and interrupts power to the entire system when an excessive temperature is reached in the furnace. Also, a normally closed pressure sensitive switch 37 is provided in the stoker motor circuit and in the furnace. Switch 37 is operable to open in the event there is a loss of combustion air pressure and serves to de-energize the stoker motor 11 in that event. Finally, a main switch 39 is provided to turn the circuit on.

It will be apparent to those skilled in the art that various additions, substitutions, modifications and omissions can be made in the control circuit of the present invention without departing from the scope or spirit of the invention. Thus, it is intended that the present invention cover the additions, substitutions, modifications and omissions provided they come within the scope of the appended claims and their equivalents.

What is claimed is:

1. A control circuit for a solid fuel, warm air furnace which includes a combustion chamber, means for delivering solid fuel to the combustion chamber, means for delivering combustion air to the combustion chamber, and means for delivering air heated by heat from combustion of said fuel from said furnace to a comfort zone; the control circuit comprising first circuit means including first thermo-sensitive means operable in response to a temperature sensed by the first thermo-sensitive means below a first preselected temperature to energize the fuel delivery means and the combustion air delivery means, second circuit means including a second thermo-sensitive means and operable in response to a temperature related to furnace performance above a second preselected temperature to energize said heated air delivery means and to interrupt the first circuit means while maintaining the combustion air delivery means energized, said second thermo-sensitive means being operable to interrupt the second circuit means in response to furnace performance related temperatures below said second preselected temperature, said first circuit means being operable to re-energize the fuel delivery means and the combustion air delivery means upon interruption of said second circuit means if the temperature sensed by said first thermo-sensitive means remains below said first preselected temperature.

2. The control circuit claimed in claim 1, including a third circuit means including a third thermo-sensitive means responsive to a temperature related to fuel combustion and operable at temperatures below a third preselected level and during periods when the temperature sensed by the first thermo-sensitive means is at or above the first preselected temperature to energize the fuel delivery means and the combustion air delivery means, said third temperature-sensitive means being operable to interrupt the third circuit means in response to a fuel combustion related temperature above said third preselected level.

3. The control circuit claimed in claim 11 wherein said second thermo-sensitive means is operable to measure the heat of combustion in said furnace combustion chamber.

4. The control circuit as claimed in claim 2, wherein the temperature setting at which said third thermo-sensitive means is responsive is variable to accommodate use with different fuels.

5. The control circuit claimed in claim 1, said first circuit means including a thermostat, a relay connected to said thermostat and operable to receive a signal therefrom when the temperature sensed by said thermostat is below a first preselected temperature, said first circuit means further including a mechanical relay which is energized by said first mentioned relay and is operable, when energized, to energize said fuel delivery means and said combustion air delivery means.

6. A control circuit is claimed in claim 5, said second circuit means including a second mechanical relay connected to said combustion air delivery means and to said second thermo-sensitive means, said second thermo-sensitive means being operable to interrupt power to said first mentioned relay and to energize said second mechanical relay in response to a temperature related to furnace performance above said second preselected temperature.

7. A control circuit is claimed in claim 6, further including a third circuit means including a third thermo-sensitive means responsive to a temperature related to fuel combustion and operable at temperatures below a third preselected level and during periods when the temperature sensed by the first thermo-sensitive means is at or above the first preselected temperature to energize the fuel delivery means and the combustion air delivery means, said third temperature responsive means being operable to interrupt the third circuit means in response to a fuel combustion related temperature above the third preselected level.

8. A control circuit is claimed in claim 7, said third circuit means including a normally closed, thermo-sensitive switch connected to said first mechanical relay.

9. A control circuit for a solid fuel warm air furnace which includes a combustion chamber, means for delivering solid fuel to the combustion chamber, means for delivering combustion air to the combustion chamber, and a flue gas exit; the control circuit comprising first circuit means including first thermo-sensitive means operable in response to a temperature sensed by the first thermo-sensitive means below a first preselected temperature to energize the fuel delivery means and the combustion air delivery means, second circuit means including second thermo-sensitive means and operable in response to a temperature related to furnace performance above a second preselected temperature to interrupt the first circuit means while maintaining the combustion air delivery means energized, said second thermo-sensitive means being operable to interrupt the second circuit means in response to furnace performance related temperatures below said second preselected temperature, said first circuit means being operable to re-energize the fuel delivery means and the combustion air delivery means upon interruption of said second circuit means if the temperature sensed by said first thermo-sensitive means remains below said first preselected temperature, said control circuit including a third circuit means including a third thermo-sensitive means positioned at said flue gas exit responsive to the temperature therein and operable at temperatures below a third preselected level and during periods when the temperature sensed by the first thermo-sensitive means is at or above the first preselected temperature to energize the fuel delivery means and the combustion air delivery means, said third temperature sensitive means being operable to interrupt the third circuit means in response to a fuel combustion related temperature above said third preselected level.

* * * * *